US005079534A

United States Patent [19]

Steingroever et al.

[11] Patent Number: 5,079,534

[45] Date of Patent: Jan. 7, 1992

[54] ELECTROMAGNET WITH PRESS DIE AND ADJUSTABLE AIR GAP

[76] Inventors: Erich Steingroever, Flensburger Str. 33, 5300 Bonn 1; Dietrich Steingroever, Im Mondsröttchen 37, Bergisch Gladbach 1, both of Fed. Rep. of Germany

[21] Appl. No.: 584,139

[22] Filed: Sep. 18, 1990

[30] Foreign Application Priority Data

Sep. 22, 1989 [DE] Fed. Rep. of Germany ..... 3931628

[51] Int. Cl.[5] ..... H01F 7/20; H01F 13/00; H01F 7/06; C21D 1/04

[52] U.S. Cl. ..... 335/284; 29/602.1; 29/608; 100/917; 264/DIG. 58; 148/103; 148/108

[58] Field of Search ..... 335/284; 29/602.1, 608, 29/609, DIG. 95; 100/917; 26/DIG. 58; 148/103, 104, 105, 108

[56] References Cited

U.S. PATENT DOCUMENTS 3,250,831 5/1966 Hooper ..... 29/608
3,412,461 11/1968 Cochardt ..... 29/608

FOREIGN PATENT DOCUMENTS 2313755 12/1976 France ..... 29/608
41172 12/1907 Switzerland ..... 335/284

*Primary Examiner*—Leo P. Picard
*Assistant Examiner*—Ramon M. Barrera
*Attorney, Agent, or Firm*—Harold Gell

[57] ABSTRACT

An apparatus for magnetizing a permanent magnet which includes a frame including first and second relatively movable members arranged to form a core frame which supports first and second conic co-axial poles enclosed by the movable frame members for creating a magnetic flux circuit with an adjustable air gap for enclosing a product to be magnetized. The apparatus is energized by coils wound about the poles and enclosing the air gap. The poles include a bore co-axially aligned with the co-axial axis of the poles and a press ram dimensioned to move within the bore.

17 Claims, 3 Drawing Sheets

ELECTROMAGNET WITH PRESS DIE AND ADJUSTABLE AIR GAP

FIELD OF THE INVENTION

The invention refers to electromagnets with adjustable air gaps for the generation of high magnetic field intensities. They are used for research purposes, as well as for the magnetization of permanent magnets with high field intensities, for tracing the hysteresis curve of permanent magnets, for the production of anisotropic permanent magnets made from magnetic powder with a bonding agent during a press process, and for similar purposes.

BACKGROUND OF THE INVENTION

Known electromagnets for high field intensities have a fixed soft iron frame, in which two co-axial poles with current coils are mounted rigidly. Their air gap is not adjustable.

Electromagnets are also known, which have a lower pole with a field coil connected rigidly to a fixed soft iron frame, and where the upper pole moves through an opening in the upper crossbar of the frame, thus enabling different air gaps to be adjusted. The field coil around the upper pole is rigidly connected to the crossbar of the frame. With these electromagnets, the maximum field strength is limited because the movement of the upper pole requires a field coil with cylindrical bore can only incompletely enclose the conic part of the upper pole.

OBJECTIVES OF THE INVENTION

The invention solves the problem of creating an electromagnet with adjustable air gap and highest possible field intensity by the means named in the main claim and the subclaims.

Maximum possible field intensity means that the planes of the poles facing the air gap are interspersed at least by the flux created by the saturation polarization Js with lowest possible electrical power in the field coils, particularly flux densities of more than 2 Tesla.

SUMMARY OF THE INVENTION

Electromagnet for high field intensities with adjustable air gap and with two co-axial poles in a rectangular frame, which consists of a U-shaped lower part and an adjustable upper part.

BRIEF DESCRIPTION OF THE DRAWINGS

Embodiments of the invention are depicted in FIGS. 1 through 8.

DETAILED DESCRIPTION OF THE INVENTION

Figure 1:
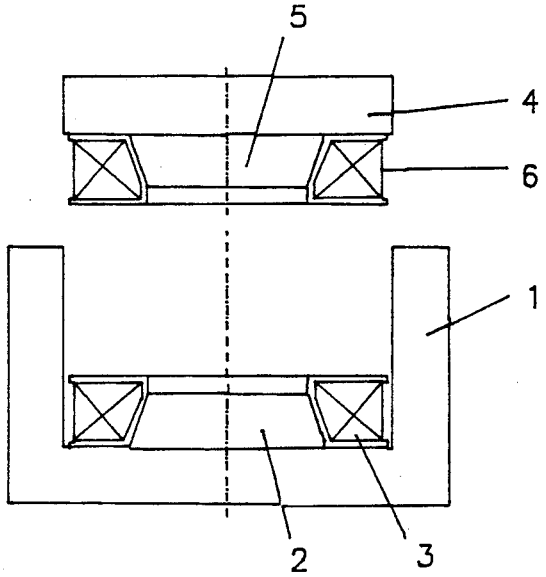
FIG. 1 is an electromagnet, open, with the upper plate elevated.

In FIG. 1, 1 is an upright U-shaped open frame according to the invention, in which the conic lower pole 2 and its tightly enclosing fixed lower field coil 3 are mounted rigidly. 4 is the upper crossbar of the frame which functions as a rear closure member with the conic pole 5 and the upper field coil 6.

Figure 2:
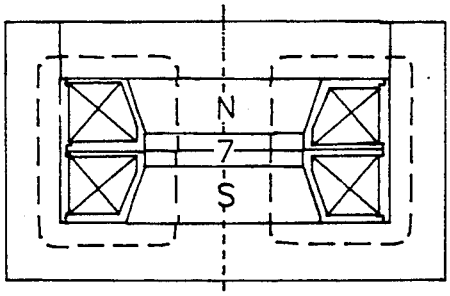
FIG. 2 illustrates the electromagnet closed, with an empty air gap.

FIG. 2 shows the frame closed with the air gap 7. The space around both poles and the air gap are tightly enclosed by both field coils. The course of the magnetic flux is indicated with a broken line, the poles North and South are designated N and S.

Figure 3:
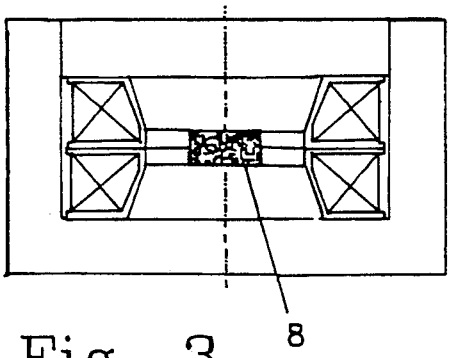
FIGS. 3 and 4 illustrate the electromagnet closed, with a permanent magnet to be magnetized in the air gap.

In FIG. 3, the same electromagnet is shown with a permanent magnet 8 to be magnetized in the air gap.

Figure 4:
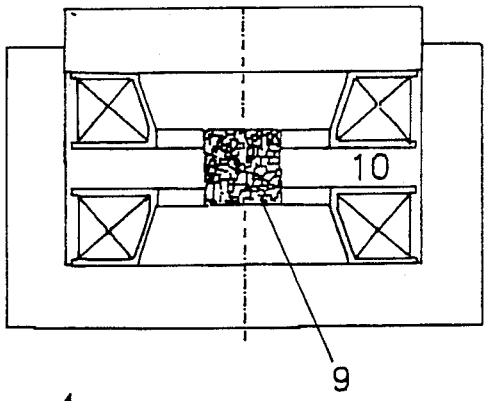

FIG. 4 shows an electromagnet according to the invention, with a permanent magnet 9 of greater height in the air gap. The field coils from FIG. 3 here are a certain distance 10 from each other, yet still generate a higher field strength in the air gap and in the permanent magnet. For maximum field strength, however, field coils should be used with greater lengths to completely fill up the space around the air gap and the poles.

Figure 5:
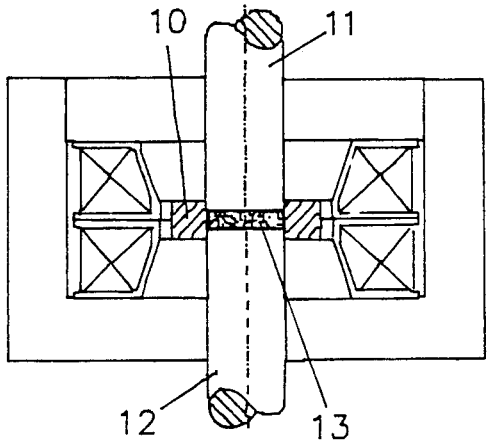
FIG. 5 illustrates the electromagnet closed with the air gap containing a press die which is filled with magnet powder compacted by two press punches.

In FIG. 5 a press die 10 is shown in the air gap, as well as two press moulds 11 and 12 and a pressed piece 13 contained in the matrix and already compacted.

Figure 6:
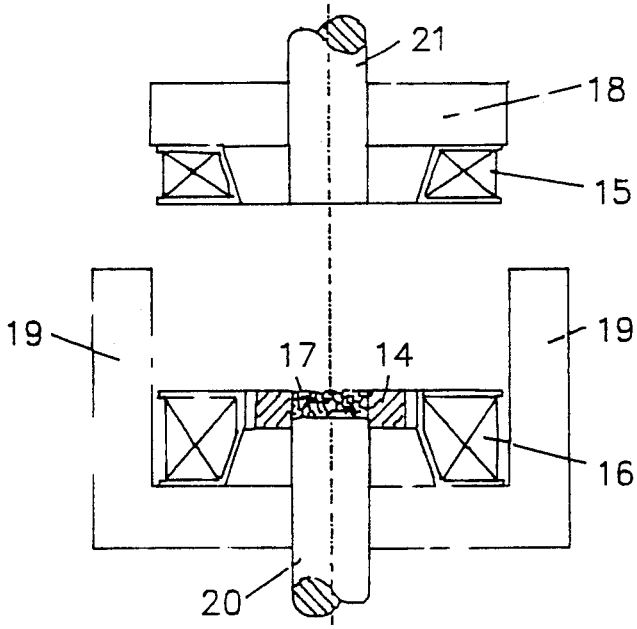
FIG. 6 is another embodiment of an electromagnet where the upper part is elevated and the lower edge of the upper coil lies in the plane of the lower edge of the upper pole.

According to the invention, the design of the electromagnet as in FIG. 6 allows for easy accessibility to the press die 14, where both field coils 15 and 16 are of different heights, so that the lower edge of the upper field coil 15 lies in the plane of the lower edge of the upper pole or the upper edge of the press die 14, which enables easy filling into the press hollow 17, e.g. with a filler neck. After filling of the powder to be compacted, the upper part 18 of the frame is driven into the two legs 19 of the lower part, until the upper pole lies on top of the die. Then, the powder can be compacted into the die 17 by the two press punches 20 and 21 of which at least one may slide through bores through the pole pieces as a press ram, whereby a high orienting field is created especially by the inner windings of the field coils which are conic on the inside.

Figure 7:
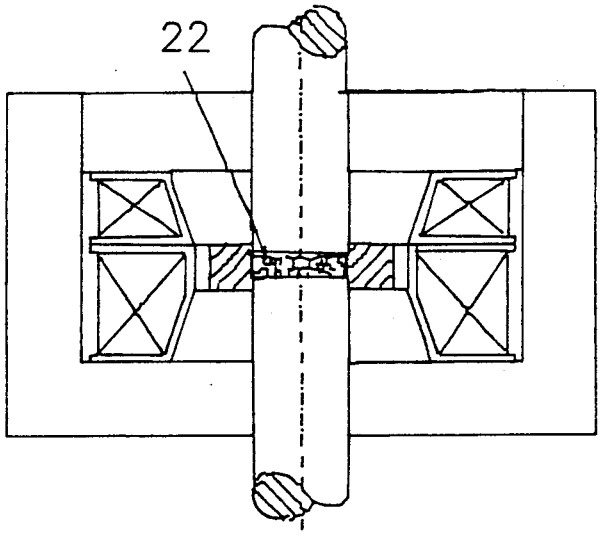
FIG. 7 illustrates the electromagnet embodiment of FIG. 6 in the closed position with the punches pressed closed for compaction of the magnet powder.
Figure 8:
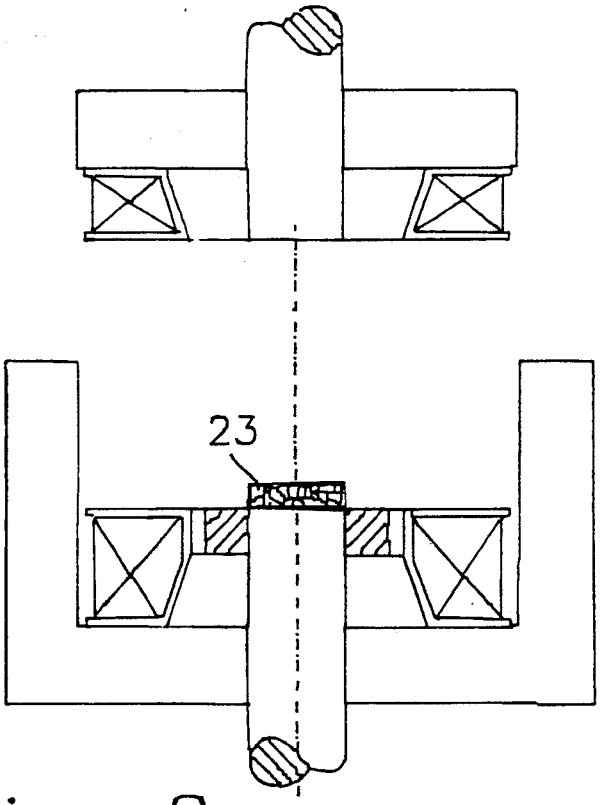
FIG. 8 illustrates the electromagnet and press punches of FIG. 7 open for removal of the magnetized, compacted magnet.

The two-part frame of the electromagnet according to the invention may be built from rectangular plates. The lateral parts, however, may also be cylindrical, whereby the upper plate must have accordingly circular or semi-circular recesses. FIG. 7 shows the position of the press punches and the pressed piece 22 after compaction, FIG. 8 shows the open electromagnet from which the pressed magnet 23 can be taken.

The electromagnet according to the invention is particularly suited for the production of press magnets from rare-earth alloys (samarium-cobalt or neodymium-iron-boron), which are sintered at a high temperature (1,000–1,200 C.) after compression, or which can be hardened at lower temperatures if a bonding agent has been added to the powder. A metallic bonding agent may also be used in know fashion, which eliminates further thermal treatment.

The described embodiment of the electromagnet according to the invention has been depicted upright.

However, it may also be used in different positions, e.g., lying down, whereby the parts designations used for the standing embodiment may be understood accordingly.

While preferred embodiments of this invention have been illustrated and described, variations and modifications may be apparent to those skilled in the art. Therefore, we do not wish to be limited thereto and ask that the scope and breadth of &:his invention be determined from the claims which follow rather than the above description.

What we claim is:

1. An electromagnet with an adjustable air gap and a frame with a rear closure member, said frame comprising a rectangular cross-section which encloses upper and lower co-axial poles with one electric coil each and a noon-magnetic press die arranged between said poles, which consists of two mutually movable parts, characterized in that said frame consists of a U-shaped lower part and an adjustable upper part and the upper edge of said lower coil lies in the plane of the upper edge of die.

2. An electromagnet according to claim 1, characterized in that said upper part can be adjusted between the legs of said U-shaped lower part.

3. An electromagnet according to claim 1, characterized in that said coils are arranged adjacent to said lower part and said upper part, and said upper coil is moved with said upper part.

4. An electromagnet according to claim 2, characterized in that said coils are arranged adjacent to said lower part and said upper part, and said upper coil is moved with said upper part.

5. An electromagnet according to claim 3, characterized in that said co-axial poles are conic poles and said coils tightly enclose said conic poles and said air gap.

6. An electromagnet according to claim 4, characterized in that said co-axial poles are conic poles and said coils tightly enclose said conic poles and said air gap.

7. An electromagnet according to claim 1, characterized in that the upper edge of said lower coil lies inn the plane of the lower edge of said upper pole and that a non-magnetic press die is arranged between said poles.

8. An electromagnet according to claim 2, characterized in that the upper edge of said lower coil lies in the plane of the lower edge of said upper pole and that a non-magnetic press die is arranged between said poles.

9. An electromagnet according to claim 1 wherein said poles include bores therethrough, comprising: ram means passing through said bores for compacting a product positioned in an air gap between said poles.

10. An electromagnet, comprising:

a frame including first and second relatively movable members;

first and second co-axial poles enclosed by said first and second relative movable frame members for creating a magnetic flux circuit with an adjustable air gap means for enclosing a product to be magnetized;

first and second electric coil means for magnetically energizing said first and second poles respectively, characterized in that the upper edge of said second coil lies in the plane of the lower edge of said first pole; and a non-magnetic press die arranged between said poles.

11. An electromagnet as defined in claim 10, wherein at least one of said poles includes a bore co-axially aligned along said co-axial axis of said poles and a press ram dimensioned to move within said bore.

12. An electromagnet as defined in claim 11 wherein said first frame member is dimensioned to slide within said second frame member.

13. An apparatus for magnetizing a permanent magnet, comprising:

a frame including first and second relatively movable members;

first and second co-axial poles enclosed by said first and second relative movable frame members for creating a magnetic flux circuit with an adjustable air gap means for enclosing a product to be magnetized;

first and second electric coils wound about said first and second poles respectively; a die; and said first and second electric coils dimensioned to enclose said air gap and said die.

14. An apparatus for magnetizing a permanent magnet as defined in claim 13 wherein at least one of said poles includes a bore co-axially aligned along said co-axial axis of said poles and a press ram dimensioned to move with said bore.

15. An apparatus for magnetizing a permanent magnet as defined in claim 14 wherein said first frame member slides within said second frame member and said poles are conical.

16. An electromagnet as defined in claim 10, wherein said poles include bores aligned parallel to said co-axial axis of said poles and press rams dimensioned to move within said bores.

17. An apparatus for magnetizing a permanent magnet as defined in claim 13 wherein said poles include bores aligned parallel to said co-axial axis of said poles and press rams dimensioned to move within said bores.

* * * * *

UNITED STATES PATENT AND TRADEMARK OFFICE

CERTIFICATE OF CORRECTION

PATENT NO. : 5,079,534

DATED : January 7, 1992

INVENTOR(S) : Steingroever et al

It is certified that error appears in the above-identified patent and that said Letters Patent is hereby corrected as shown below:

Column 3, claim 1, line 17: Please change "noon-magnetic" to --non-magnetic--.

Signed and Sealed this

Thirtieth Day of June, 1992

*Attest:*

DOUGLAS B. COMER

*Attesting Officer*

*Acting Commissioner of Patents and Trademarks*